US008834322B2

(12) United States Patent
Chuang

(10) Patent No.: US 8,834,322 B2
(45) Date of Patent: Sep. 16, 2014

(54) WRIST TRAINING APPARATUS

(75) Inventor: Yun-Yu Chuang, New Taipei (TW)

(73) Assignee: Nano-Second Technology Co., Ltd., New Taipei (TW)

( * ) Notice: Subject to any disclaimer, the term of this patent is extended or adjusted under 35 U.S.C. 154(b) by 245 days.

(21) Appl. No.: 13/566,139

(22) Filed: Aug. 3, 2012

(65) Prior Publication Data

US 2013/0310224 A1 Nov. 21, 2013

(30) Foreign Application Priority Data

May 17, 2012 (TW) ..... 101209367 U

(51) Int. Cl.
*A63B 23/14* (2006.01)

(52) U.S. Cl.
USPC ..... 482/45; 482/44

(58) Field of Classification Search
CPC .. A63B 23/14; A63B 23/03508; A63B 21/22; A63B 23/16; A63B 2021/222; A63B 21/1469; A63B 21/015; A63B 2220/17
USPC ..... 482/44–50
See application file for complete search history.

(56) References Cited

U.S. PATENT DOCUMENTS

| | | | | |
|---|---|---|---|---|
| 5,800,311 | A * | 9/1998 | Chuang | 482/44 |
| 6,053,846 | A * | 4/2000 | Lin | 482/44 |
| 6,186,914 | B1 * | 2/2001 | Lin | 473/594 |
| 6,623,405 | B2 * | 9/2003 | Chuang et al. | 482/44 |
| 7,381,155 | B2 * | 6/2008 | Chuang et al. | 482/45 |
| 7,736,275 | B2 * | 6/2010 | Chuang et al. | 482/44 |
| 7,736,276 | B2 * | 6/2010 | Chuang et al. | 482/44 |
| 7,846,066 | B1 * | 12/2010 | Chuang | 482/1 |
| 8,454,483 | B1 * | 6/2013 | Bradley et al. | 482/92 |
| 8,636,625 | B2 * | 1/2014 | Johnson | 482/45 |
| 2002/0068663 | A1 * | 6/2002 | Smith | 482/45 |
| 2004/0048720 | A1 * | 3/2004 | Kuo | 482/45 |
| 2004/0063546 | A1 * | 4/2004 | Chuang et al. | 482/45 |
| 2005/0101440 | A1 * | 5/2005 | Chuang et al. | 482/45 |
| 2005/0107218 | A1 * | 5/2005 | Chuang et al. | 482/45 |
| 2005/0113214 | A1 * | 5/2005 | Chuang et al. | 482/44 |
| 2006/0046900 | A1 | 3/2006 | Chuang et al. | |
| 2007/0207899 | A1 * | 9/2007 | Chuang et al. | 482/45 |
| 2008/0058166 | A1 * | 3/2008 | Chuang et al. | 482/44 |
| 2012/0302407 | A1 * | 11/2012 | Kelliher | 482/45 |
| 2013/0109540 | A1 * | 5/2013 | Chuang | 482/45 |

FOREIGN PATENT DOCUMENTS

DE 202011052088 U1 2/2012

* cited by examiner

*Primary Examiner* — Loan H Thanh
*Assistant Examiner* — Andrew S Lo
(74) *Attorney, Agent, or Firm* — WPAT, PC; Justin King

(57) ABSTRACT

A wrist training apparatus includes a housing, a rotation component disposed in the housing, a signal emission assembly and a counter. The rotation component includes a shaft and an annular wrapper wrapping the shaft and including an outer and inner surfaces and receptacle hole extending from the outer to the inner surfaces. A hole wall of the receptacle hole includes a stopper part. The signal emission assembly is disposed in the receptacle hole and includes a holding cover disposed in the receptacle hole and including a first holding structure in the receptacle hole and a second holding structure protruding from the inner surface and a signal emission device. The first and second holding structures are leaned against the stopper part and inner surface respectively. The signal emission device is disposed in the holding cover. The counter is disposed in the housing and senses signals from the signal emission device.

11 Claims, 5 Drawing Sheets

WRIST TRAINING APPARATUS

TECHNICAL FIELD

The present invention relates to a portable physical training apparatus, and more particularly to a wrist training apparatus.

BACKGROUND

In recent years, various physical training apparatuses are available in the market as people would like to pay more and more attention on their health. Each physical training apparatus has a particular function; wherein the wrist training apparatus is particularly devised for strengthening the wrist muscle as well as enhance the blood circulation thereof. In addition, to make sure that the users have a sufficient exercise, most of the wrist training apparatuses are equipped with a counter for counting the number of the wrist rotation that users have made.

FIG. 1 is a schematic cross-sectional view of a conventional wrist training apparatus. As shown, the conventional wrist training apparatus 100 includes a housing 110, a rotation component 120, a signal emission assembly 130 and a counter 140. The rotation component 120 is disposed in the housing 110 and includes a shaft 121 and an annular wrapper 122, which is configured to wrap the shaft 121. The annular wrapper 122 has an outer surface 123, an inner surface 124 and a receptacle hole 125 extending from the outer surface 123 to the inner surface 124. The signal emission assembly 130 is disposed in the receptacle hole 125; and the counter 140 is disposed in an opening 111 of the housing 110.

The rotation component 120 is driven to rotate along its rotational axis with the wrist training apparatus 100 in rotating, so that the physical training effect is achieved due to the rotation generating the centrifugal force and the centrifugal force equivalently causing the wrist training apparatus 100 having an increasing weight. In addition, because the signal emission assembly 130 is fixed on the rotation component 120 and is driven to rotate with the rotation component 120 in rotating, the counter 140 can count the number of the rotations that the wrist has made according to the signals provided from the signal emission assembly 130. Because the signal emission assembly 130 rotate with the rotation component 120 in rotating, it is important to develop a mean to dispose the signal emission assembly 130 in the receptacle hole 125 in a stable and easy manner.

SUMMARY

The present invention provides a wrist training apparatus having easy assembly and stable operation features.

An embodiment of the present invention provides a wrist training apparatus, which includes a housing, a rotation component, a signal emission assembly and a counter. The rotation component is disposed in the housing and includes a shaft and an annular wrapper. The annular wrapper is configured to wrap the shaft and includes an outer surface, an inner surface and a receptacle hole extending from the outer surface to the inner surface. A stopper part is disposed on a hole wall of the receptacle hole. The signal emission assembly is disposed in the receptacle hole and includes a holding cover and a signal emission device. The holding cover is disposed in the receptacle hole and includes a first holding structure disposed in the receptacle hole and a second holding structure protruding from the inner surface. The first holding structure is leaned against the stopper part, and the second holding structure is leaned against the inner surface. The signal emission device is disposed in the holding cover. The counter is disposed in the housing and configured to sense a signal provided from the signal emission device.

In an embodiment of the present invention, the receptacle hole is defined with a first receptacle space and a second receptacle space communicable to each other. The first receptacle space is defined between the outer surface and the second receptacle space. The first receptacle space is configured to have an inner diameter greater than the second receptacle space has. The stopper part is formed on the junction of the first receptacle space and the second receptacle space.

In an embodiment of the present invention, the holding cover includes a tubular part and at least one elastomeric member. The tubular part is disposed with the signal emission device therein. The tubular part includes a first part and a second part connected to each other. The first part is disposed in the first receptacle space. The second part is disposed in the second receptacle space. The first part is configured to have an outer diameter greater than the second part has. The first holding structure is formed on the junction of the first part and the second part. The elastomeric member is connected to a terminal end, the one far away the first part, of the second part. The elastomeric member includes a holding hook protruding from the inner surface. The second holding structure includes the holding hook.

In an embodiment of the present invention, the first part is latched in the first receptacle space, the second part is latched in the second receptacle space.

In an embodiment of the present invention, the signal emission device includes a magnet.

In an embodiment of the present invention, the shaft and the annular wrapper have a one-piece structure.

In an embodiment of the present invention, the tubular part and the elastomeric member have a one-piece structure.

In an embodiment of the present invention, the outer surface of the annular wrapper is disposed with at least one annular groove surrounding the shaft.

In an embodiment of the present invention, the housing comprises a first cover and a second cover capable of being attached to each other, a terminal end, the one far away the second cover, of the first cover is defined with an opening, in which the counter is disposed.

In an embodiment of the present invention, the aforementioned wrist training apparatus further includes a holding ring, a first annular track and a second annular track. The holding ring is configured to wrap the joining part of the first and second covers. The first annular track is disposed in the first cover. The second annular track is disposed in the second cover. The two terminal ends of the shaft are disposed between the first annular track and the second annular track.

In an embodiment of the present invention, the rotation component further includes a rotation ring with two opposite shaft holes. The two terminal ends of the shaft are inserted through and extended out of the respective shaft holes.

In summary, because the signal emission assembly can be inserted into the receptacle hole through the outer surface of the annular wrapper, the wrist training apparatus according to the present invention can have an easy assembly feature. In addition, because the first holding structure of the holding cover is leaned against the stopper part, the signal emission assembly can be prevented from being apart from the rotation component in a direction toward the shaft. Moreover, because the second holding structure of the holding cover is leaned against the inner surface of the annular wrapper, the holding cover can be prevented from being apart from the rotation component in a direction away from the shaft by the centrifugal force generated by the rotation of the rotation component.

Therefore, the wrist training apparatus according to the present embodiment can have easy assembly and stable operation features.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
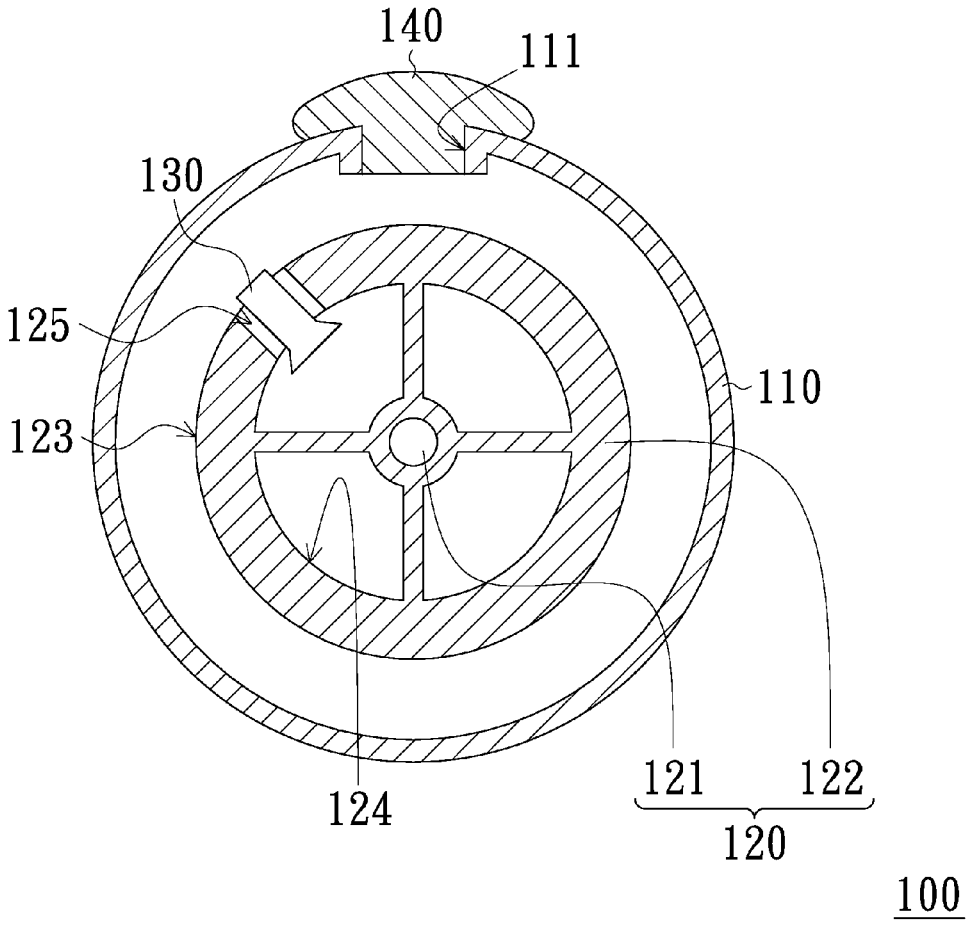
FIG. 1 (Prior Art)
FIG. 1 is a schematic cross-sectional view of a conventional wrist training apparatus.
Figure 2A:
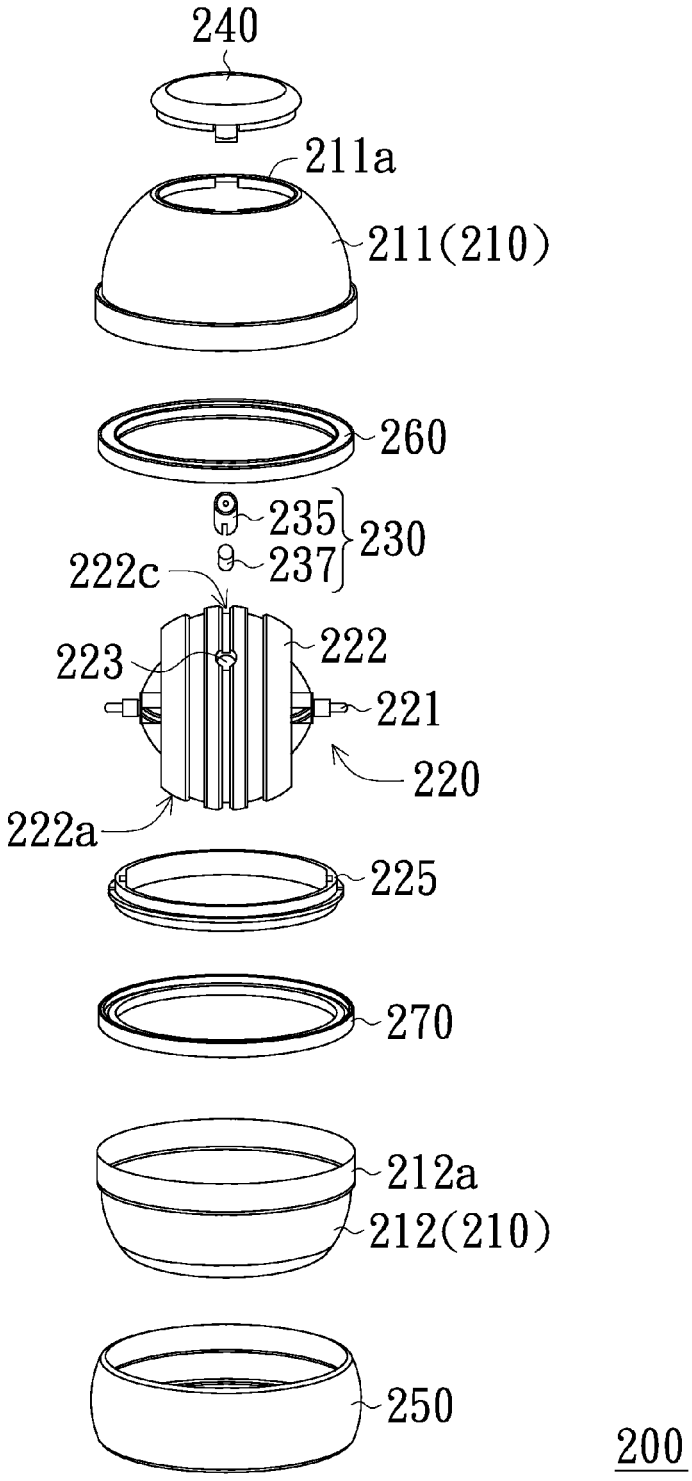
FIG. 2A is a schematic exploded three-dimensional view of a wrist training apparatus in accordance with an embodiment of the present invention.
Figure 2B:
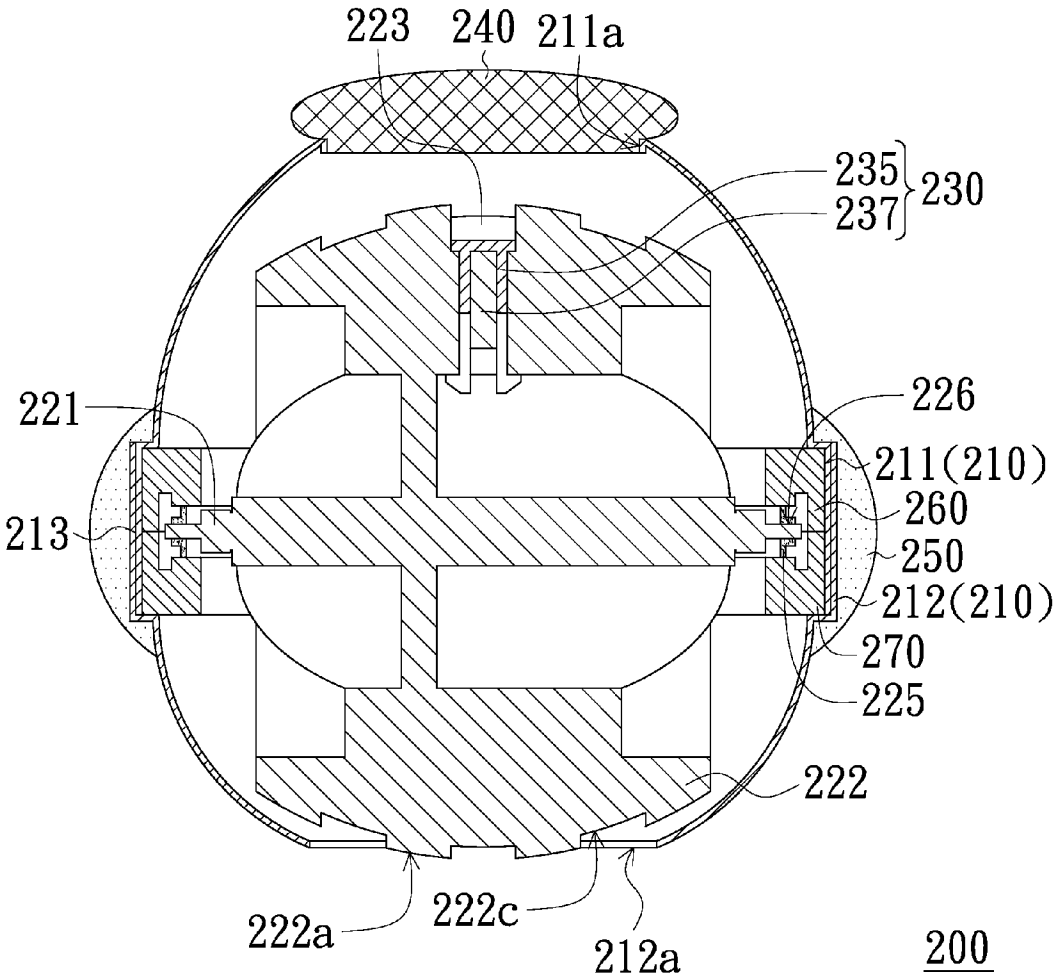
FIG. 2B is a schematic cross-sectional view of the wrist training apparatus shown in FIG. 2A after being assembled.

FIG. 2A is a schematic exploded three-dimensional view of a wrist training apparatus in accordance with an embodiment of the present invention; and FIG. 2B is a schematic cross-sectional view of the wrist training apparatus shown in FIG. 2A after being assembled. Please refer to FIGS. 2A, 2B both. The wrist training apparatus 200 in this embodiment includes a housing 210, a rotation component 220, a signal emission assembly 230 and a counter 240. The rotation component 220 is disposed in the housing 210 and includes a shaft 221 and an annular wrapper 222. The annular wrapper 222 is configured to wrap the shaft 221, and the signal emission assembly 230 is disposed in the annular wrapper 222. The signal emission assembly 230 includes a holding cover 235 and a signal emission device 237, which is disposed in the holding cover 235. The counter 240 is disposed in the housing 210 and configured to sense the signals provided from the signal emission device 237.

In this embodiment the signal emission device 237 is a magnet, and the present embodiment is not limited thereto. Specifically, because the signal emission device 237 is driven to rotate with the rotation component 220 in rotating, the counter 240 can count the number of the rotations of the rotation component 220 according to the changes of the sensed signal generated by the magnetic field.

The housing 210 includes, for example, a first cover 211 and a second cover 212 capable of being attached to each other. The attachment of the first cover 211 and the second cover 212 can be realized by threads or latching manner, and the present embodiment is not limited thereto. One terminal end (the one far away the second cover 212) of the first cover 211 is defined with an opening 211*a*, in which the counter 240 is disposed. The wrist training apparatus 200 further includes a holding ring 250, a first annular track 260 and a second annular track 270. The holding ring 250 is configured to wrap the joining part 213 of the first annular track 260 and the second annular track 270, and thereby preventing the first annular track 260 and the second annular track 270 from separating from each other. The first annular track 260 is disposed in the first cover 211; the second annular track 270 is disposed in the second cover 212; and the two terminal ends of the shaft 221 are disposed between the first annular track 260 and the second annular track 270. Specifically, to make the shaft 221 rotate, the first annular track 260 and the second annular track 270 are selected to have materials capable of resulting in sufficient friction coefficient between the shaft 221 and the first annular track 260 as well as the second annular track 270. For example, the first annular track 260 and the second annular track 270 can be made of plastic or resin materials, and the present embodiment is not limited thereto.

It is to be noted that if the friction coefficient between the two terminal ends of the shaft 211 and the first cover 211 as well as the second cover 212 is sufficient enough and the shaft 211 is capable of rotating, the two terminal ends of the shaft 211 can be directly leaned against the first cover 211 and the second cover 212, and accordingly the first annular tract 260 and the second annular track 270 can be omitted.

In this embodiment, the shaft 221 and the annular wrapper 222 can have a one-piece structure, the rotation component 220 can be manufactured by an injection molding process, and the present embodiment is not limited thereto. In addition, the rotation component 220 may further include a rotation ring 225 with two opposite shaft holes 226; wherein the two terminal ends of the shaft 221 are inserted through and extended out of the respective shaft holes 226. The rotation ring 225 is disposed between the first annular track 260 and the second annular track 270.

In addition, the outer surface 222*a* of the annular wrapper 222 may be further disposed with an annular groove 222*c* surrounding the shaft 221. The number of the annular groove 222*c* can be one or more than one, and the present embodiment is exemplified by having three annular grooves 222*c*. Because the rotation component 220 is exposed from an opening 212*a* of the second cover 212, the annular grooves 222*c* can prevent user from being pinched by the gap formed between the annular wrapper 222 and the second cover 212, and thereby increasing the safety of the wrist training apparatus 200 according to the present embodiment.

Figure 3A:
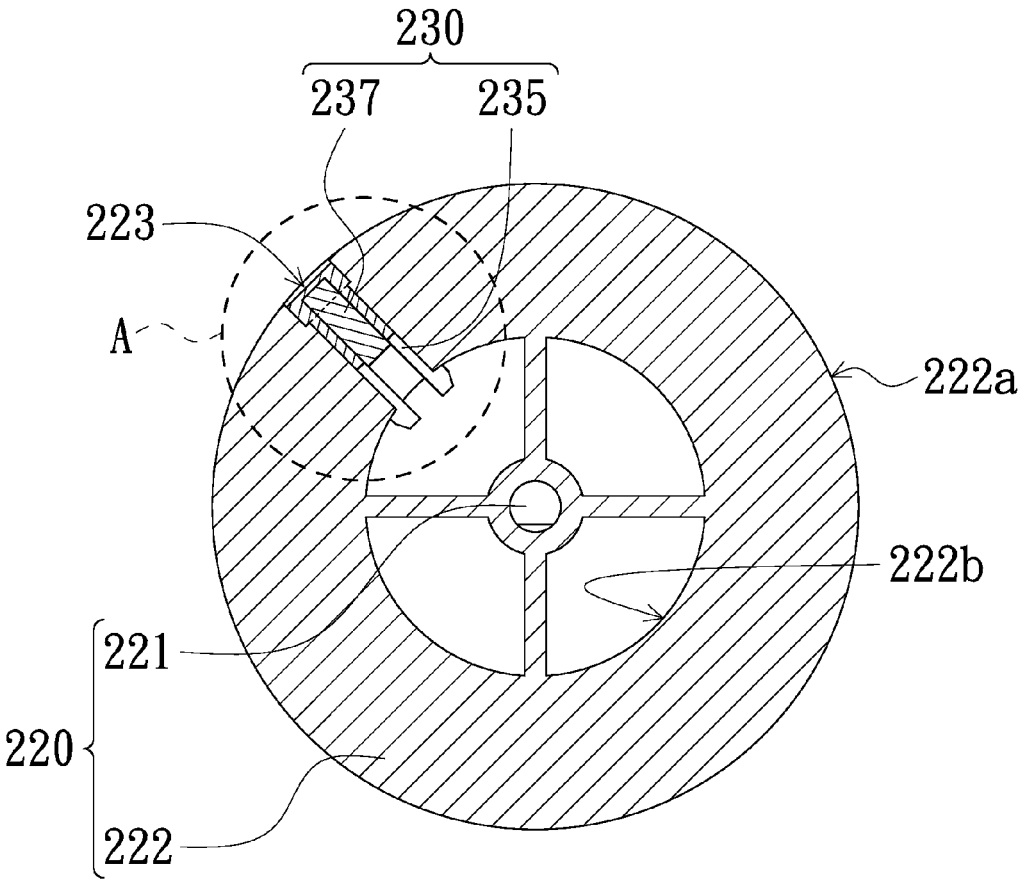
FIG. 3A is a schematic cross-sectional view of the rotation component and the signal emission assembly in FIG. 2A after being assembled.
Figure 3B:
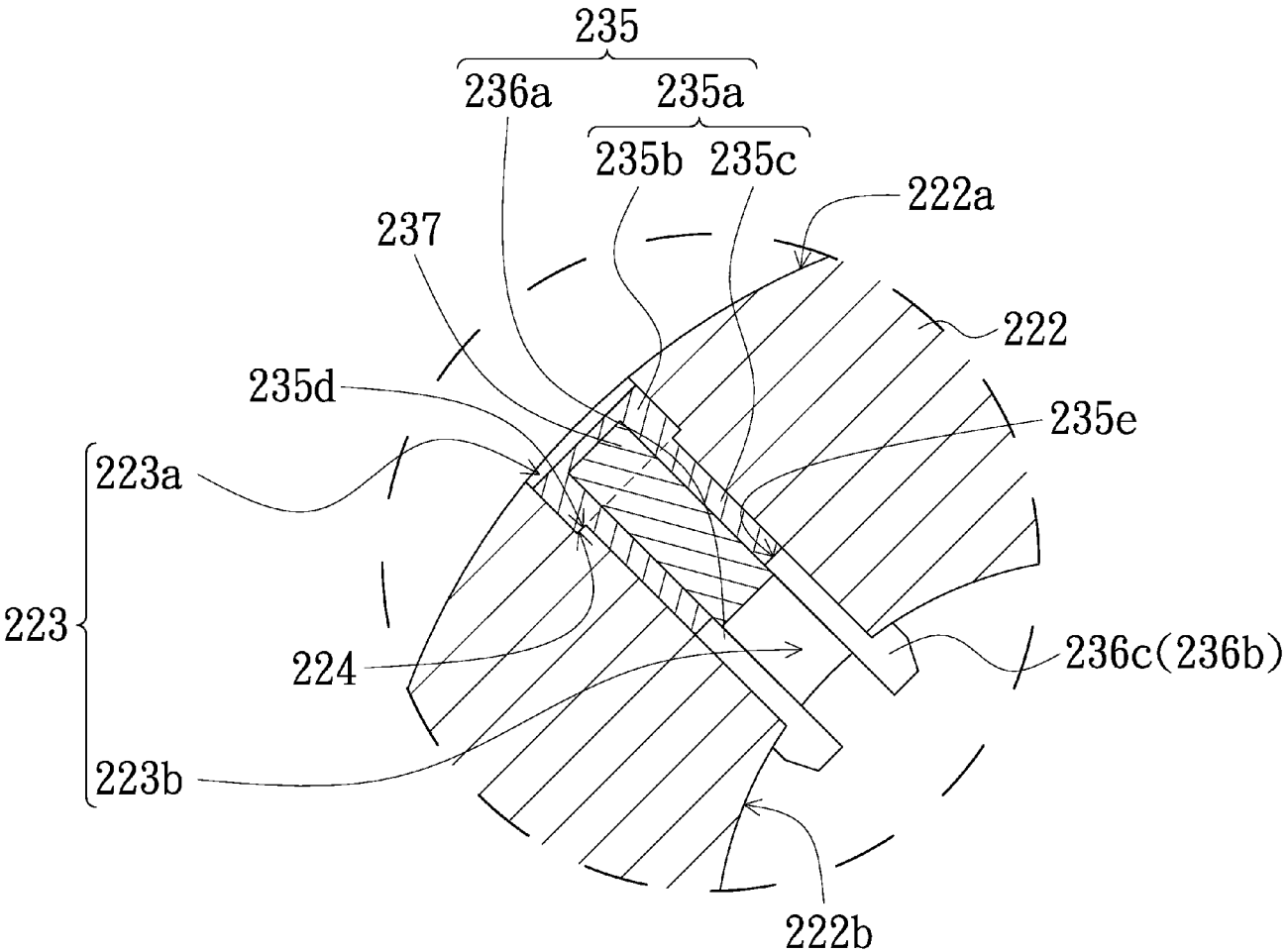
FIG. 3B is a schematic enlarged view of the area A shown in FIG. 3A.

FIG. 3A is a schematic cross-sectional view of the rotation component 220 and the signal emission assembly 230 in FIG. 2A after being assembled; and FIG. 3B is a schematic enlarged view of the area A shown in FIG. 3A. Please refer to FIGS. 3A, 3B both. The annular wrapper 222 has an outer surface 222*a*, an inner surface 222*b* and a receptacle hole 223 extending from the outer surface 222*a* to the inner surface 222*b*; wherein the receptacle hole 223 is disposed with a stopper part 224 on a hole wall thereof. The signal emission assembly 230 is disposed in the receptacle hole 223. Specifically, the holding cover 235 of the signal emission assembly 230 is disposed in the receptacle hole 223; the holding cover 235 has a first holding structure 235*d* disposed in the receptacle hole 223 and a second holding structure 236*b* protruding from the inner surface 222*b*. The first holding structure 235*d* is leaned against the stopper part 224; and the second holding structure 236*b* is leaned against the inner surface 222*b*.

In this embodiment, the receptacle hole 223 is defined with a first receptacle space 223*a* and a second receptacle space 223*b* communicable to each other. Specifically, the first receptacle space 223*a*, defined between the outer surface 222*a* of the annular wrapper 222 and the second receptacle space 223*b*, is configured to have an inner diameter greater than the second receptacle space 223*b* has. The stopper part 224 is formed on the junction of the first receptacle space

223*a* and the second receptacle space 223*b*. In this embodiment the stopper part 224 is an annular plane, and the present embodiment is not limited thereto.

The holding cover 235 includes a tubular part 235*a* and at least one elastomeric member 236*a*; it is to be noted that the holding cover 235 in this embodiment is exemplified by including a plurality of elastomeric members 236*a*. The signal emission device 237 is disposed in the tubular part 235*a*. The tubular part 235*a* and the elastomeric members 236*a* can have a one-piece structure. The holding cover 235 is made of plastic or resin materials, and the present embodiment is not limited thereto. In addition, the tubular part 235*a* includes a first part 235*b* and a second part 235*c* connected to each other. The first part 235*b* is disposed in the first receptacle space 223*a*; the second part 235*c* is disposed in the second receptacle space 223*b*; and the first part 235*b* is configured to have an outer diameter greater than the second part 235*c* has. The first holding structure 235*d* is formed on the junction of the first part 235*b* and the second part 235*c*. In this embodiment, the first holding structure 235*d* is an annular plane protruding from the second part 235*c*, and the present embodiment is not limited thereto. In addition, the first part 235*b* is latched in the first receptacle space 223*a*; and the second part 235*c* is latched in the second receptacle space 223*b*. To have a stable assembly, the outer diameter of the second part 235*c* and the inner diameter of the second receptacle space 223*b* are configured to have a transition fit, and the outer diameter of the first part 235*b* and the inner diameter of the first receptacle space 223*a* are configured to have a transition fit. In addition, the elastomeric members 236*a* each are connected to the terminal end 235*e* (the one far away the first part 235*b*) of the second part 235*c* and have a holding hook 236*c* protruding from the inner surface 222*b*. The second holding structure 236*b* includes the holding hooks 236*c*; in other words, the holding hooks 236*c* are referred to as the second holding structure 236*b* in this embodiment.

In this embodiment, because the first receptacle space 223*a* is configured to have an inner diameter greater than the second receptacle space 223*b* has, the signal emission assembly 230 can be inserted into the receptacle hole 223 through the outer surface 222*a* of the annular wrapper 222 and thereby having an easy assembly feature. In addition, because the first holding structure 235*d* of the holding cover 235 is leaned against the stopper part 224, the signal emission assembly 230 can be prevented from being apart from the rotation component 220 in a direction toward the shaft 221. In addition, because the second holding structure 236*b* of the holding cover 235 is leaned against the inner surface 222*b* of the annular wrapper 222, the holding cover 235 can be prevented from being apart from the rotation component 220 in a direction away from the shaft 221 by the centrifugal force generated by the rotation of the rotation component 220. Therefore, the wrist training apparatus 200 according to the present embodiment can have easy assembly and stable operation features.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wrist training apparatus, comprising:

a housing;

a rotation component disposed in the housing and comprising:

a shaft; and an annular wrapper configured to wrap the shaft and comprising an outer surface, an inner surface and a receptacle hole extending from the outer surface to the inner surface, a stopper part being disposed on a hole wall of the receptacle hole;

a signal emission assembly disposed in the receptacle hole and comprising:

a holding cover disposed in the receptacle hole, the holding cover comprising a first holding structure disposed in the receptacle hole and a second holding structure protruding from the inner surface, the first holding structure being leaned against the stopper part, and the second holding structure being leaned against the inner surface; and a signal emission device disposed in the holding cover; and a counter disposed in the housing and configured to sense a signal provided from the signal emission device.

2. The wrist training apparatus according to claim 1, wherein the receptacle hole is defined with a first receptacle space and a second receptacle space communicable to each other, the first receptacle space is defined between the outer surface and the second receptacle space, wherein the first receptacle space is configured to have an inner diameter greater than a diameter the second receptacle space, and the stopper part is formed on a junction of the first receptacle space and the second receptacle space.

3. The wrist training apparatus according to claim 2, wherein the holding cover comprises:

a tubular part disposed with the signal emission device therein, the tubular part comprising a first part and a second part connected to each other, the first part being disposed in the first receptacle space, the second part being disposed in the second receptacle space, the first part being configured to have an outer diameter greater than a diameter of the second part, the first holding structure being formed on the junction of the first part and the second part; and at least one elastomeric member connected to a terminal end of the second part, the elastomeric member comprising a holding hook protruding from the inner surface, the second holding structure comprising the holding hook.

4. The wrist training apparatus according to claim 3, wherein the first part is latched in the first receptacle space, the second part is latched in the second receptacle space.

5. The wrist training apparatus according to claim 1, wherein the signal emission device comprises a magnet.

6. The wrist training apparatus according to claim 1, wherein the shaft and the annular wrapper have a one-piece structure.

7. The wrist training apparatus according to claim 3, wherein the tubular part and the elastomeric member have a one-piece structure.

8. The wrist training apparatus according to claim 1, wherein the outer surface of the annular wrapper is disposed with at least one annular groove surrounding the shaft.

9. The wrist training apparatus according to claim 1, wherein the housing comprises a first cover and a second cover capable of being attached to each other, wherein of the first cover is defined with an opening, in which the counter is disposed.

10. The wrist training apparatus according to claim 9, further comprising:

a holding ring configured to wrap the joining part of the first and second covers;

a first annular track disposed in the first cover; and a second annular track disposed in the second cover, wherein the two terminal ends of the shaft are disposed between the first annular track and the second annular track.

11. The wrist exercising device according to claim 1, wherein the rotation component further comprises a rotation ring with two opposite shaft holes, and two terminal ends of the shaft are inserted through and extended out of the respective shaft holes.

* * * * *